US010814951B2

(12) United States Patent
Burger

(10) Patent No.: US 10,814,951 B2
(45) Date of Patent: Oct. 27, 2020

(54) DEVICE FOR ADJUSTING A HARNESS LINE FOR A SAIL-BOARD

(71) Applicant: Nicolas Burger, Jouy en Josas (FR)

(72) Inventor: Nicolas Burger, Jouy en Josas (FR)

( * ) Notice: Subject to any disclaimer, the term of this patent is extended or adjusted under 35 U.S.C. 154(b) by 0 days.

(21) Appl. No.: 16/372,507

(22) Filed: Apr. 2, 2019

(65) Prior Publication Data

US 2019/0315443 A1 Oct. 17, 2019

(51) Int. Cl.
*B63H 8/54* (2020.01)

(52) U.S. Cl.
CPC ..... *B63H 8/54* (2020.02)

(58) Field of Classification Search
CPC ..... B63H 8/54
See application file for complete search history.

(56) References Cited

U.S. PATENT DOCUMENTS

| | | | | |
|---|---|---|---|---|
| 4,418,631 | A * | 12/1983 | Frohbach | B63H 8/54 114/39.12 |
| 4,523,537 | A | 6/1985 | Kowol | |
| 5,197,402 | A | 3/1993 | Hunts | |
| 5,215,023 | A * | 6/1993 | Johnson | B63H 8/54 114/39.18 |
| 7,152,543 | B2 | 12/2006 | Raimondo | |
| 2006/0137588 | A1 * | 6/2006 | Raimondo | B63H 9/1085 114/102.1 |

FOREIGN PATENT DOCUMENTS

| | | | |
|---|---|---|---|
| DE | 28 37 534 | A1 | 3/1980 |
| DE | 29 39 182 | A1 | 4/1981 |
| DE | 2939182 | A | 4/1981 |
| DE | 32 43 539 | A1 | 11/1982 |
| DE | 32 16 704 | A1 | 11/1983 |
| DE | 3216704 | A1 | 11/1983 |
| DE | 41 28 232 | C1 | 8/1992 |
| DE | 4128232 | C1 | 8/1992 |
| DE | 41 13 439 | A1 | 10/1992 |
| DE | 4113439 | A1 | 10/1992 |
| EP | 0 039 927 | B1 | 6/1984 |

(Continued)

OTHER PUBLICATIONS

French Patent Office Opinion on Patentability dated Dec. 4, 2018 in French application FR1870439 (4 pages).

(Continued)

*Primary Examiner* — Stephen P Avila
(74) *Attorney, Agent, or Firm* — McDonnell Boehnen Hulbert & Berghoff LLP

(57) ABSTRACT

The invention relates to a device for adjusting the attachment points of a harness line (2) on a boom (1) for a sail-board or the like. It is in particular remarkable in that it includes a carriage (3) that is mounted sliding inside or outside the boom (1) or in an attached part. The harness line (2) passes through the passage orifices of the carriage (6*a*-6*b*) in order to form a loop (4), which allows the user to hang by his harness. The carriage (3) can be locked by an appropriate system. This device makes it possible to correct the position of the loop (4) easily during operation of the sail-board in the water by unlocking the carriage, sliding it and locking it in a new position. The length of the loop (4) can be adjusted by shortening or lengthening the harness line (2) with a clam cleat.

12 Claims, 3 Drawing Sheets

(56) References Cited

FOREIGN PATENT DOCUMENTS

| | | | |
|---|---|---|---|
| FR | 2 676 206 | A1 | 5/1991 |
| FR | 2676206 | A1 | 5/1991 |
| GB | 2 255 540 | A | 11/1992 |
| GB | 2255540 | A | 11/1992 |

OTHER PUBLICATIONS

English translation of French Patent Office Opinion on Patentability dated Dec. 4, 2018 in French application FR1870439 (4 pages).

* cited by examiner

Sectional view along B-B

DEVICE FOR ADJUSTING A HARNESS LINE FOR A SAIL-BOARD

CROSS-REFERENCE TO RELATED APPLICATIONS

This application claims priority under 35 U.S.C. § 119 to French application FR1870439, filed Apr. 12, 2018, and titled "Dispositif de réglage du bout de harnais intégré au wishbone." The entire contents of application FR1870439 are incorporated herein by reference for all purposes.

OVERVIEW

The present invention relates to a device for adjusting attachment points of a harness line for sail-boards or the like.

A sail-board is made up of a float and a sail, the mast of which is mounted on an articulation fastened to the float and includes a boom. The boom is made up of two curved tubes that come together in the front at the boom handle, which forms the junction with the mast, and at the rear at the clew. A rope called a harness line is fastened on each tube of the boom. The harness line has two attachment points on each boom tube. The harness is a device worn by the user like a belt that includes a hook, allowing him to attach himself to the sail by a central loop formed by the harness line. Thus, the user can offset the thrust of the sail by his weight suspended from the boom.

To optimize the adjustment, the user seeks to adjust the attachment points of the harness line on the boom on either side of the center of thrust of the sail and such that each attachment point is equidistant from the center of thrust. He does this typically before leaving the shore or dock, but during operation of the sail-board in the water, he may wish to refine or modify this adjustment because it is not optimal or has become nonoptimal during operation of the sail-board. This is very difficult, if not impossible, to do with current devices, which are generally made up of a rope attached to two velcro fasteners that each connect on the boom tube. The velcro fasteners are very difficult to move with one hand.

The invention includes various embodiments of a device that make it possible to change this adjustment easily during navigation and/or operation of the sailboard. Some embodiments include a carriage that is mounted sliding on the boom and that includes passage orifices for the harness rope and a locking device on the boom.

This device makes it possible to correct the initial adjustment easily with one hand, by opening the locking device, sliding the carriage with one finger of one hand or shifting one's weight in the desired direction, and lastly closing the locking device of the carriage on the boom. Furthermore, this device also makes it possible, owing to a clam cleat, to vary the length of the harness line, if the central loop length is not optimal. For safety reasons, this clam cleat can be actuated to completely free the harness line of the boom and thus completely free the hook of the harness from any connection with the boom.

According to one embodiment, the carriage is mounted sliding on the outside of a boom tube. It may also be mounted sliding inside a boom tube or on an attached part. The device works with a carriage subject to either a stretching force or a compression force, depending on how the harness line is passed through the orifices as shown in the figures.

These as well as other aspects, advantages, and alternatives will become apparent to those of ordinary skill in the art by reading the following detailed description, with reference where appropriate to the accompanying drawings.

BRIEF DESCRIPTION OF THE DRAWINGS

Other features and advantages of the invention will emerge from the following description, done in reference to the appended drawings, in which.

DETAILED DESCRIPTION

Example embodiments are described herein. It should be understood that the words "example," "exemplary," and "illustrative" are used herein to mean "serving as an example, instance, or illustration." Any embodiment or feature described herein as being an "example," being "exemplary," or being "illustrative" is not necessarily to be construed as preferred or advantageous over other embodiments or features. The example embodiments described herein are not meant to be limiting. It will be readily understood that the aspects of the present disclosure, as generally described herein, and illustrated in the figures, can be arranged, substituted, combined, separated, and designed in a wide variety of different configurations, all of which are explicitly contemplated herein.

Figure 1:
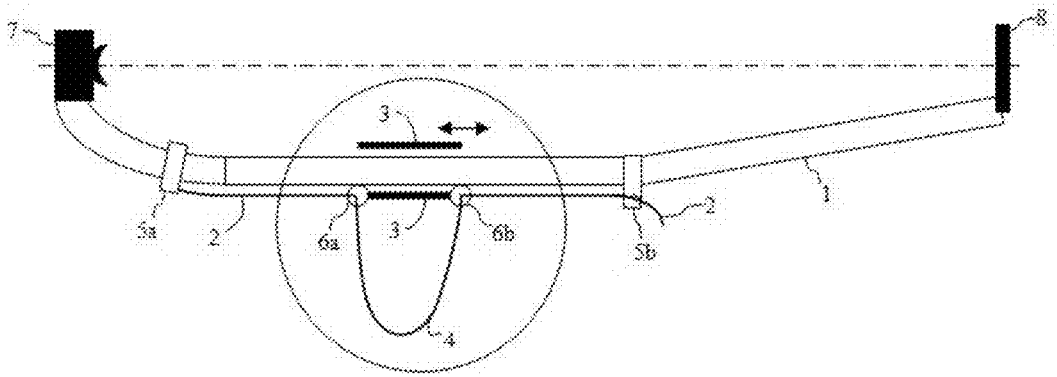
FIG. 1 shows one of the tubes of the boom with a carriage provided for operation in stretching mode.

FIG. 1 shows a schematic view of the operating principle. The boom tube (1) terminates at one end on the handle of the boom (7) and on the other side with the clew (8). The carriage (3) can slide on the boom tube (1) laterally. It can be locked in a position by an appropriate system.

The harness line (2) is fastened on the boom at stops: (5*a*) and (5*b*). It passes through the carriage (3) through two passage orifices (6*a*) and (6*b*) between which a central loop (4) is arranged. During operation of the sail-board, the length of the loop (4) can be adjusted by shortening or lengthening the harness line (2) with a clam cleat at the stop (5*b*). Conversely, the stop (5*a*) near the boom handle (7) keeps the other end of the harness line (2) stationary with no possibility of adjustment.

The carriage (3), by sliding, moves the loop (4). The position of the loop (4) on the boom (1) therefore depends on the position of the carriage (3). The carriage (3), by moving, keeps the length of the loop constant, since the two passage orifices (6*a*) and (6*b*) have a constant separation.

The described device works via either stretching or compression, depending on how the harness line is passed through the orifices as shown in the figures, as follows:

To work in stretching mode (cf. FIG. 1), the harness line (2) passes through a first orifice (6*a*) arranged at one end of the carriage (3), then forms the loop (4) and passes back through a second orifice (6*b*) arranged at the other end of the carriage (3). This generates a stretching force on the carriage (3) when the weight of the user is attached to the loop (4).

Figure 2:
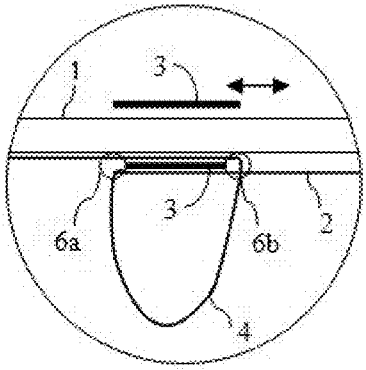
FIG. 2 is a partial view corresponding to FIG. 1 with a carriage provided for operation in compression mode.

To work in compression (cf. FIG. 2), the harness line (2) first forms a passage in the carriage (3), then leaves through the orifice (6*b*) opposite the stop point (5*a*) where it is anchored in the boom, then forms the loop (4) and lastly once again enters inside the carriage through the orifice (6*a*) before ending its journey in the boom stop (5*b*). Thus, the double passage of the line in the carriage generates a compression force on the carriage when the weight of the user is attached to the loop (4).

According to a first embodiment called "ring," the carriage (3) is mounted sliding outside of the boom tube.

According to a second embodiment called "shuttle," the carriage (3) slides inside of the boom tube.

According to a third embodiment called "attached part," the carriage (3) is mounted sliding on an attached part fastened on the boom.

Figure 3B:
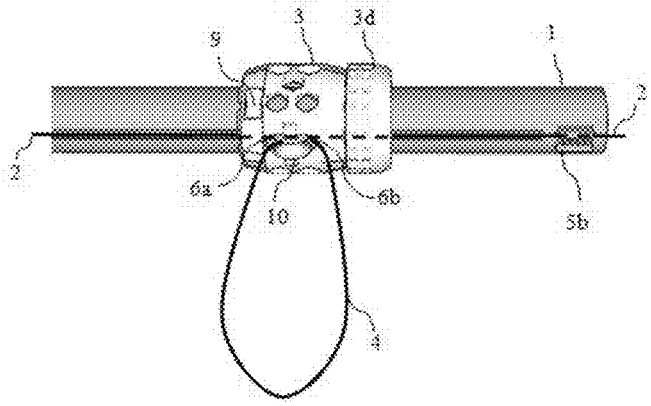
FIG. 3B is a detail view of one embodiment of the carriage configured for sliding outside of the boom with a compact single-piece carriage.
Figure 3A:
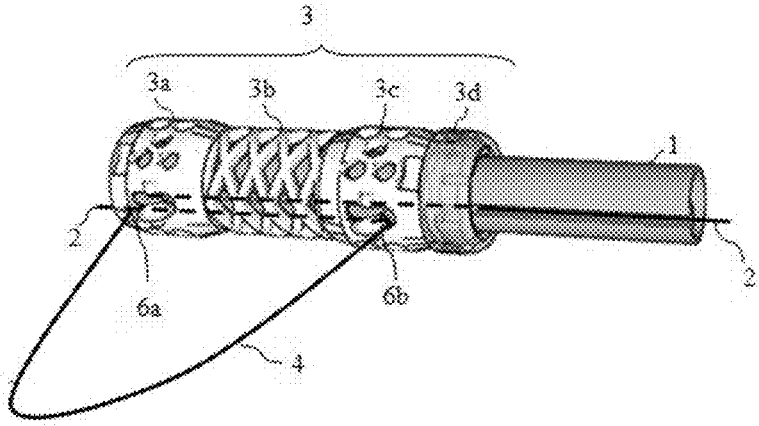
FIG. 3A is a detail view of one embodiment of the carriage configured for sliding outside of the boom.

FIG. 3A shows an embodiment of the "ring" type.

The carriage (3) comprises four elements:

a first ring (3*a*) that makes it possible to guide the carriage (3) along the axis of the boom (1). The outlet orifice (6*a*) of the ring (3*a*) is equipped with a pulley.

a second ring (3*c*) similar to (3*a*) except that the second ring (3*c*) is welded to a locking system (3*d*). The outlet orifice (6*b*) of the ring (3*c*) is equipped with a pulley.

a spacer (3*b*) that makes the connection between the first ring (3*a*) and the second ring (3*c*). In some embodiments, the spacer (3*b*) is helical, which serves to absorb the curves of the boom tube, although in the diagrams, for simplification reasons, the boom tubes are shown with straight segments.

the locking system (3*d*) of the carriage (3) on the boom tube (1).

The rings (3*a*) and (3*c*) are open-worked, as is the spacer (3*b*), to allow the water to pass more easily, which will thus make it possible to clean the mechanism regularly.

The spacer (3*b*) serves to maintain the separation between the two stationary rings. In some embodiments, this element may be adjustable or otherwise configurable for different sizes, for example 5 cm, 10 cm, 15 cm, 20 cm to allow users to adapt the separation to their adjustment habits or other personal preferences.

Figure 4:
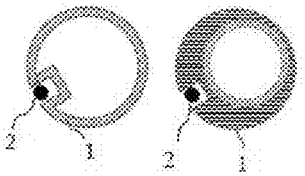
FIG. 4 is a sectional view of the boom tube with two embodiment variants.

In FIG. 4, two sectional examples are shown of a boom tube section (1) on the sliding zone of the carriage (3). One can see that the boom has a channel that can house up to two pieces of harness line (2) side by side.

Two variants of boom tubes can be considered:

in the left illustration of FIG. 4, the boom tube (1) has been preformed to have this channel, in the right illustration of FIG. 4, a cylindrical shape having a channel has been "molded" above the original boom tube (1).

Figure 5:
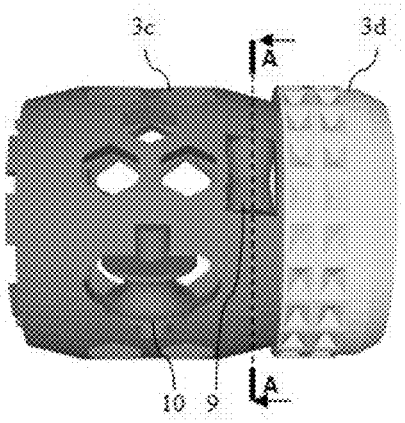
FIG. 5 shows one of the main elements of the carriage of FIG. 3A: the ring equipped with a locking feature.

In FIGS. 5 (side view) and 6 (sectional view), one can see several details of the rings (3*a*) or (3*c*):

a pulley (10) allows optimal sliding of the harness line (2) in the orifice of the ring in order to create the loop (4) of the harness line (2).

A fine adjustment device (9) is formed by a biconical thumb wheel rolling on the boom tube (1). When the user actuates the thumb wheel with his thumb, he can move the position of the carriage (3) in a micrometric manner on the boom (1).

The cylindrical rolling bearings (11) make it possible to guide the ring in a longitudinal sliding movement on the boom tube (1). These series of seven or eight rolling bearings are housed at both ends of the ring (3*a*), (3*c*) to provide optimal sliding once the locking system is unlocked. Some embodiments may have more or fewer rolling bearings than what is shown in FIG. 6.

The ring-type operating mode can be mechanically simplified. In FIG. 3A, a first simplification stage includes removing the spacer to bring the pulleys closer together and merge the 2 rings into one then equipped with 2 pulleys. FIG. 3B shows this simplification pushed to the extreme, where only one pulley has been retained. The operating principle of the carriage (3) of FIG. 3B is the same as that of the carriage (3) of FIG. 3A, with the only difference that the carriage is made up of a single ring (3) and its locking system (3*d*).

Figure 6:
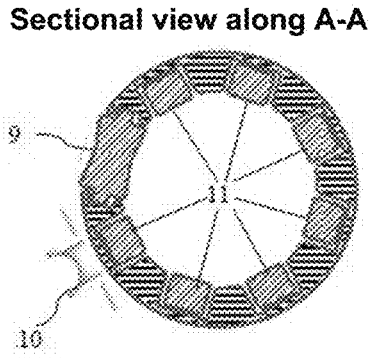
FIG. 6 is a sectional view of the ring of FIG. 5.

A pulley (10) and the thumb wheel (9) for fine adjustment perform the same functions as what is described for FIGS. 5 and 6.

The orifices (6*a*) and (6*b*) are located on either side of the pulley (10).

The clam cleat (5*b*) makes it possible to adjust and lock the length of the loop (4).

Figure 7:
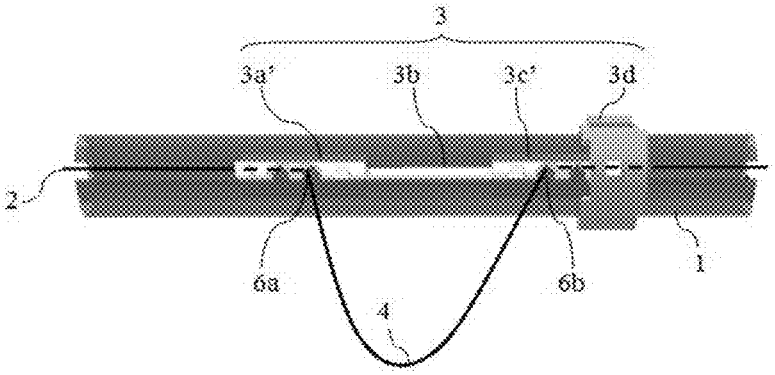
FIG. 7 shows one embodiment of the carriage configured for sliding inside of the boom.

FIGS. 7 (in side view) and 8 (perspective three-quarters view) show an embodiment of the "shuttle" type.

The carriage (3) comprises four elements:

a first shuttle (3*a*') that makes it possible to guide the carriage (3) inside the boom tube (1). The outlet orifice (6*a*) of the shuttle (3*a*') is equipped with a pulley.

a second shuttle (3*c*') similar to (3*a*'). The outlet orifice (6*b*) of the second shuttle (3*c*') is equipped with a pulley.

A coupler (3*b*') that makes the junction between the first shuttle (3*a*') and the second shuttle (3*c*').

The locking clip (3*d*') of the carriage (3) on the boom tube (1), which is fitted on a rod with a square section connected to the shuttle (3*c*').

The locking clip (3*d*') comprises two modes. In the first mode, the clip is open, in which case the carriage can slide freely on the axis of the boom. In the second mode, the clip is closed, in which case the carriage is locked on the axis of the boom.

Figure 8:
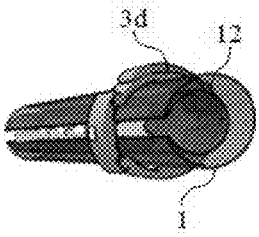
FIG. 8 is a side perspective view of the device of FIG. 7.

The shuttle mode (according to FIGS. 7 and 8) is remarkable in that the entire carriage (3) with the exception of the locking clip (3*d*') is comprised in an inner tube (12), which in turn is incorporated into the boom tube (1). In some embodiments, the inner tube (12) where the shuttles circulate is plugged at both ends to prevent water from penetrating inside the main boom tube.

Figure 9:
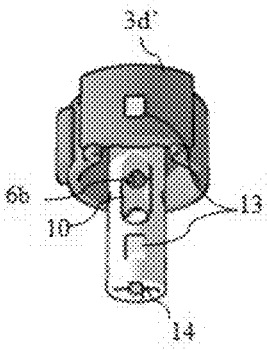
FIG. 9 shows one of the component elements of the carriage of FIG. 7: a shuttle fitted in the locking system.
Figure 10:
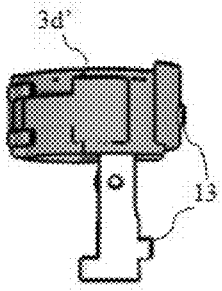
FIG. 10 is a side view of FIG. 9.
Figure 11:
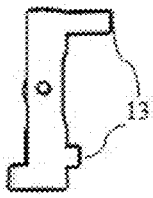
FIG. 11 is a side view of FIG. 9 without the locking system.

FIGS. 9 (front view), 10 (side view), 11 (side view of the shuttle without the locking system) make it possible to better understand the "shuttle" inner part. One can clearly see both centering elements (13), which make it possible to maintain the passage orifices (6*b*) of the harness line (2) in the direction of the outer groove of the boom tube (1). The pulley (10) makes it possible to facilitate the sliding of the line, and therefore the movement of the carriage. The cross-shaped pattern (14) at the bottom of the shuttle makes it possible to connect a coupler. Like for the spacers of the ring device, the coupler (3*b*') serves to keep the separation between the two shuttles at a fixed distance. However, in some embodiments, this element may be adjustable or otherwise configurable to different sizes, for example 5 cm, 10 cm, 15 cm, 20 cm to allow users to adapt the separation between the two shuttles to their personal preferences.

Figure 12:
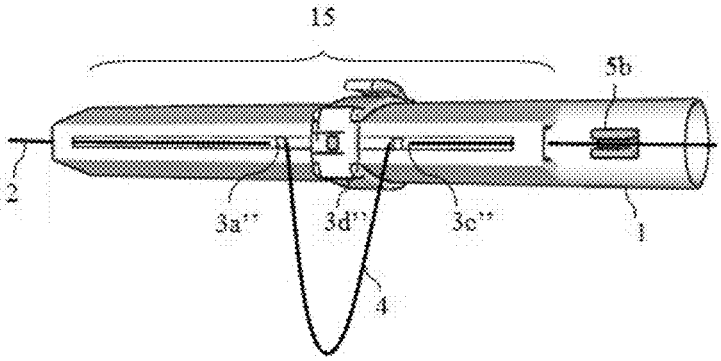
FIG. 12 is a view of the embodiment of the "attached part" type.
Figure 14:
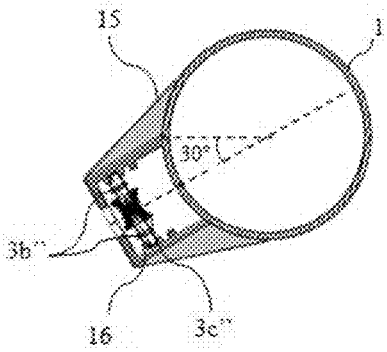
FIG. 14 is a sectional view of a section of the attached part and the boom tube represented in FIG. 12 without the locking feature.
Figure 15:
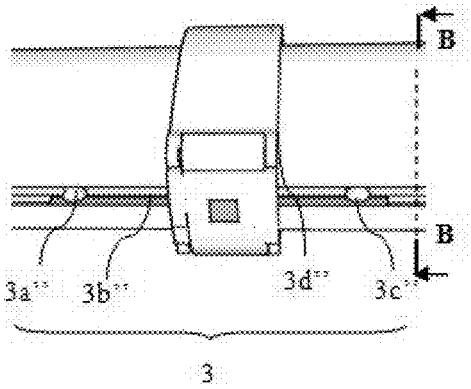
FIG. 15 is an enlarged view of FIG. 12 with a slightly different viewing angle that makes it possible to see the carriage slightly better.

FIGS. 12 (in side perspective view) and 13 (three-quarters perspective view) show an embodiment of the "attached part" type. FIG. 14 is a sectional view of a section of the attached part and the boom tube, and lastly FIG. 15 is an enlarged view of FIG. 12 with a slightly different viewing angle that makes it possible to understand the detail of the component parts of the carriage (3) and also of the locking system (3*d*") along the boom tube (1).

Figure 13:
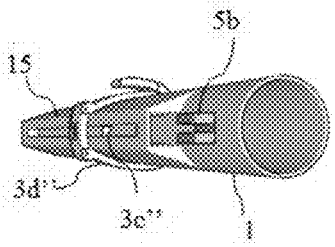
FIG. 13 is a side perspective view of the device of FIG. 12.

One can see in FIGS. 12 and 13 that the attached part (15) creates a protuberance on the boom tube (1). The attached part (15) includes a notch on its outer face that makes it possible to pass the harness loop (4) outside the mechanism. In some embodiments, for better ergonomics and less friction, this notch will be oriented at 30° downward relative to a horizontal plane.

The harness line (2) passes through the attached part, and leaves the latter to form a loop (4) between the two pulleys (3*a*") and (3*b*"), and lastly returns into the attached part (15) up to its end and is next locked relative to the clam cleat (5*b*), which is aligned with the attached part.

In FIG. 14, the attached part (15) contains an inner groove (16) that makes it possible to guide the carriage over the adjusting zone of the harness line. As a result, all of the useful adjustments of the carriage (3) are done with only 30 to 40 cm of attached part for a boom with an average length of 1.80 m.

According to FIG. 15, the carriage (3) includes four elements.

- a first pulley with its rotation axis (3*a*") sliding in the groove (16) of the attached part, which makes it possible to guide the carriage (3) inside the attached part (15).
- a second pulley with its rotation axis (3*c*") similar to (3*a*").
- a coupler (3*b*") that makes the junction between the first pulley (3*a*") and the second (3*c*"). This coupler exists in duplicate (one on each side of the rotation axis of the pulleys), as can be seen in FIG. 14.
- the locking clip (3*d*") of the carriage (3) on the boom tube (1) is fitted on a rod with a square section connected to the middle of the two couplers (3*b*").

Like for the spacer (3*b*) of the ring device, the double coupler (3*b*") serves to keep the separation between the two stationary pulleys. However, in some embodiments, this element may be adjustable or otherwise configurable to different sizes, for example 5 cm, 10 cm, 15 cm, 20 cm to allow users to adapt the separation between the pulleys to their personal preferences.

EXAMPLE EMBODIMENTS

Some embodiments include a device for sail-boards or the like allowing the adjustment of the position and length of the harness line on the boom with a single hand, characterized in that the device includes a "carriage" (3) that is mounted sliding relative to the boom tube (1) and that includes a locking system (3*d*) for locking its sliding movement, a rope or line (2) passing through said carriage (3) so as to create a loop (4) between the orifices (6*a*) and (6*b*) of said carriage (3), two stops (5*a*) and (5*b*) fastened on the boom that retain said line (2) at both of its ends, said stop (5*b*) in turn being equipped with a clam cleat that makes it possible to shorten or lengthen said line (2).

In some embodiments, the carriage (3) is mounted sliding above a cylindrical shape molded on the boom tube (1), and the cylindrical shape includes a channel to house the line (2) between the two stops (5*a*) and (5*b*).

In some embodiments, the carriage (3) is mounted sliding outside the boom tube (1), which incorporates a channel to house the line (2) between the two stops (5*a*) and (5*b*).

In some embodiments, the carriage (3), in order to assume different lengths, comprises multiple modules: a first ring (3*a*) including an orifice (6*a*), a spacer (3*b*) with a predefined length (several possible lengths) to have the desired separation between the orifices (6*a*) and (6*b*), another ring (3*c*) including an orifice (6*b*), a locking system (3*d*) on the boom (1). In some embodiments, some of the modules may be welded to one another.

In some embodiments, the carriage (3) is open-worked in order to clean the sliding mechanism in contact with the water.

In some embodiments, the carriage (3) includes rolling bearings (11) making it possible to guide the sliding movement along the boom (1).

In some embodiments, the carriage (3) includes orifices (6*a*) and (6*b*) that are equipped with pulleys (10) to better slide the harness line (2).

In some embodiments, the device includes a fine adjustment system (9) for the position of the carriage (3).

In some embodiments, the boom tube (1) includes an attached part (15) or protuberance with an inner groove (16) guiding the sliding of the carriage (3), said protuberance being passed through by a notch leaving an opening to allow the harness loop (4) and the locking clip (3*d*") to pass to the outside.

In some embodiments, the device, with the exception of the locking clip (3*d*') and the harness loop (4), is comprised in an inner tube (12) which in turn is incorporated into the boom tube (1), said inner tube (12) being plugged at both ends to prevent water from penetrating inside the boom tube (1).

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A device configured for adjusting a position and length of a harness line on a boom of a sail-board with a single hand, wherein the device comprises:

- a carriage comprising a first orifice and a second orifice, wherein the carriage is configured to slide relative to a portion of the boom, wherein the carriage comprises a locking system configured to control sliding movement of the carriage;
- a harness line passing through the carriage and creating a loop between the first orifice and the second orifice of the carriage; and a first stop and a second stop fastened on the boom, wherein the first stop is configured to retain a first end of the harness line and the second stop is configured to retain a second end of the harness line, and wherein the second stop comprises a clam cleat configured to allow shortening or lengthening of the harness line between the first stop and the second stop.

2. The device of claim 1, wherein at least a portion of the boom over which the carriage is configured to slide is fitted with a cylindrical sleeve mounted over the boom, and wherein the cylindrical sleeve comprises a channel to house at least a portion of the harness line between the first stop and the second stop.

3. The device of claim 1, wherein at least a portion of the boom comprises a channel to house at least a portion of the harness line between the first stop and the second stop.

4. The device of claim 1, wherein the carriage is configurable to form different lengths via arrangement of a plurality of modules comprising:

a first ring comprising the first orifice;

a second ring comprising the second orifice;

an adjustable spacer configurable to adjust separation between the first orifice and the second orifice; and the locking system on the boom.

5. The device of claim 4, wherein one or more of the first ring, the second ring, the adjustable spacer, or the locking system are combined to form a single component.

6. The device of claim 1, wherein the carriage is open-worked and configured to allow cleaning of the carriage with water.

7. The device of claim 1, wherein the carriage comprises a plurality of rolling members configured to facilitate sliding movement of the carriage along the boom.

8. The device according to claim 1, wherein the first orifice comprises a first pulley, wherein the second orifice comprises a second pulley, and wherein the first pulley and the second pulley are configured to facilitate sliding of the harness line.

9. The device of claim 1, further comprising:

an adjustment system configured to facilitate positioning of the carriage along the boom.

10. The device of claim 9, wherein the adjustment system comprises a thumb wheel configured to enable rolling of the carriage along the boom.

11. The device of claim 1, wherein at least a portion of the boom comprises a protuberance comprising:

an inner groove configured to guide sliding of the carriage along the boom; and a notch passing through at least a portion of the protuberance forming an opening configured to allow the harness line loop and partially a locking clip to pass outside of the protuberance.

12. The device of claim 1, wherein at least a portion of the device is enclosed within an inner tube having a first end and a second end, wherein the inner tube is at least partially enclosed within the boom, and wherein the first end of the inner tube and the second end of the inner tube are configured to prevent water from entering at least a portion of the boom.

* * * * *